US005636693A

United States Patent [19]

Elmer

[11] Patent Number: 5,636,693

[45] Date of Patent: Jun. 10, 1997

[54] GAS WELL TUBING FLOW RATE CONTROL

[75] Inventor: William G. Elmer, Midland, Tex.

[73] Assignee: Conoco Inc., Ponca City, Okla.

[21] Appl. No.: 359,783

[22] Filed: Dec. 20, 1994

[51] Int. Cl.[6] ..... E21B 43/16

[52] U.S. Cl. ..... 166/370; 166/53; 166/91.1; 166/372

[58] Field of Search ..... 166/372, 370, 166/53, 91

[56] References Cited

U.S. PATENT DOCUMENTS

| | | | |
|---|---|---|---|
| 1,754,945 | 4/1930 | Haskell | 166/372 |
| 1,754,946 | 4/1930 | Haskell | 166/53 |
| 2,293,196 | 8/1942 | Crump | 166/372 X |
| 3,396,793 | 8/1968 | Piper et al. | 166/53 |
| 3,678,997 | 7/1972 | Borchard | 166/53 |
| 3,863,714 | 2/1975 | Watson | 166/53 |
| 4,226,284 | 10/1980 | Evans | 166/53 X |
| 4,275,790 | 6/1981 | Abercrombie | 166/53 X |
| 4,509,599 | 4/1985 | Chenoweth et al. | 166/370 |
| 5,006,046 | 4/1991 | Buckman et al. | 166/372 X |

FOREIGN PATENT DOCUMENTS

| | | | |
|---|---|---|---|
| 345266 | 8/1972 | U.S.S.R. | 166/53 |

OTHER PUBLICATIONS

"A Practical Approach to Removing Gas Well Liquids", Edward J. Hutlas and William R. Granberry, Journal of Petroleum Technology, Aug., 1972, pp. 916–922.

"Gas Well Operation With Liquid Production", SPE 11583, Society of Petroleum Engineers, J. F. Lea, Jr. and R. E. Tighe, pp. 307–319.

*Primary Examiner*—Hoang C. Dang
*Attorney, Agent, or Firm*—John E. Holder

[57] ABSTRACT

Gas in association with liquids is produced from a wellbore by disposing a first tubing string having a first fluid communication path into the wellbore to near or below the bottom of a producing zone, disposing within the annulus between the first tubing string and the outer surface of the wellbore a second fluid communication path from near or below the bottom of the producing zone to an offtake line at the surface, disposing a choke means in at least one of the fluid communication paths, and producing gas while controlling the choke means to establish sufficient gas flow up the first fluid communication path so as to unload liquids from near or below the bottom of the producing zone and produce the liquids up the first tubing string in association with gas flow. In accordance with a preferred embodiment, the first tubing string has a sufficiently small diameter that liquids can be unloaded from the well over life of the production. Preferably, the choke means is a valve automatically controlled by differential pressure controller measuring pressure differential across an orifice plate in the first fluid communication path.

9 Claims, 1 Drawing Sheet

GAS WELL TUBING FLOW RATE CONTROL

BACKGROUND OF THE INVENTION

1. Field of the Invention

This invention relates in general to oil and gas flow production, and in particular to a system for removal of accumulated liquid from gas producing wells.

2. Description of the Prior Art

Many gas wells produce both gas and liquid such as water, oil, and condensate. The gas is often flowed from the casing to a sales line or offtake line at the surface. Part of the liquid, initially entrained as droplets in gas flow, may drop out of the flow because of insufficient velocity of gas. The liquid can accumulate in the bottom of the well or near the bottom of the producing formation. As accumulation increases, it can exert an increasingly large back pressure on the formation. This back pressure, which equals the hydrostatic head of the liquid column, may be large enough to reduce the production rate of the gas well or even completely stop production.

It is therefore highly advantageous to remove liquids from gas wells so as to prevent such accumulation in the wellbore and consequent back pressure on the producing formation.

The prior art has taken various approaches to removing such gas well liquids which exert back pressure on a producing formation. A brief description of the state of the art is provided in "*A Practical Approach to Removing Gas Well Liquids*", Edward J. Hutlas and William R. Granberry, Journal of Petroleum Technology, August, 1972, pages 916–922. Sometimes wells are blown periodically to remove liquids along with the thus very rapidly produced gas. Often times, siphon strings or velocity tubes are run and the pumper unloads the liquids from the wells from time to time by opening such siphon strings or velocity tubes to atmospheric pressure; thus blowing liquids from near the bottom of the well. Sometimes small holes are drilled in the siphon strings to aid in lifting the liquids. These "weepholes" enable gas to enter into the tubing at intervals uphole, providing additional lift toward the surface, a gas lift effect. Time clock intermitters and differential pressure intermitters are also often used as disclosed in the article. Pumps and combination liquid diverter and gas lift installations are also often used as is described in the article.

U.S. Pat. No. 4,275,790 discloses another approach wherein the well has a tubing string located inside the casing, with the tubing in contact with the accumulated liquid. Both the tubing and the casing are connected to the sales line or offtake line. Periodically, both the casing and tubing are shut in, allowing formation pressure to build up in the casing. Then the tubing is opened to the sales line to discharge accumulated liquid, it being driven by the higher formation pressure that has built up.

U.S. Pat. No. 4,509,599 discloses a system wherein a compressor is employed to pump gas from a tubing string pathway disposed in a gas well to a gas pathway which runs up the annulus, thus unloading liquids from near the bottom of the well via the tubing pathway.

U.S. Pat. No. 3,863,714 discloses an automatic gas well control device which optimizes gas well production by allowing the well to produce only while adequate flow rates are maintained. The device includes a control valve and discharge line which is responsive to the pressure differential between the tubing and sales line and to the rate of discharge from the well as measured by differential pilot valves. One pilot valve sends a pneumatic signal to close the control valve when the rate of production drops below a predetermined level to thus shut in the well and permit gas pressure to build to a sufficient level for acceptable production. Another pilot valve monitors sales and tubing line pressure and operates to send a signal to the control valve to open the control valve only when the tubing pressure exceeds the sales line pressure by a predetermined differential.

Thus, since natural gas fills a growing percentage of our nations energy requirements due to its availability, relatively low price, and clean burning qualities, and since deliverabilities of gas wells decline over time and discovery of new gas reservoirs becomes more difficult, it is needed to maximize gas recovery from every gas well, so that gas supplies are not left untapped.

As pointed in the article by Hutlas and Granberry, the primary disadvantage that has limited wider utilization of smaller tubing strings as a solution to the liquid build up is the associated pressure drop caused at higher flow rates through relatively small diameter tubing string. Although ideal for gas wells near the end of their producing life (many old wells are being retrofitted with smaller tubing everyday), a smaller tubing would be too restrictive to produce wells at their maximum capabilities early in their producing life.

As is pointed out in SPE 11583 "Gas Well Operation With Liquid Production", J. F. Lea and R. E. Tighe, other methods for minimizing liquid loading are available. Well head compression, plunger lift, siphon strings, rotative gas lift, and foaming agents are known. These other methods all have disadvantages, primarily higher operating costs and maintenance requirements. The basic problem has been that for a given gas flow rate, there are only a limited range of tubing diameters that ensure adequate velocity to remove liquids, yet are not overly restrictive to flow. As gas well deliverability declines and the flow rates decrease, smaller tubing is needed. Since it is not practical nor economical to change tubing size every few years, the above other methods of liquid unloading have been subsequentially developed. There is still a great need for improved methods of liquid unloading, and the invention at hand addresses that need.

The invention at hand eliminates the flow restriction caused by smaller tubing. This allows small tubing to be installed in any gas well, eliminating liquid loading problems for almost the entire producing life of a gas well. The benefits of this are higher ultimate recovery, less well supervision, and stabilized flow rates. Smaller tubing installed upon initial well completion, is likely to be less costly than the larger tubing sizes normally employed. The smaller tubing also eliminates the need to expend capital and manpower needed for the other methods for removing liquids.

SUMMARY OF THE INVENTION

It is an object of this invention to provide an improved system for removing accumulated liquids from gas producing wells.

In essence, the invention relates to a method for producing gas in association with liquids from a wellbore comprising:

(a) disposing a first tubing string into the wellbore to near the bottom of a producing zone and having a first fluid communication path from near or below the bottom of the producing zone to an offtake line at the surface, (b) disposing within the annulus between the first tubing string and the outer surface of the wellbore a second fluid communication path from near or below the bottom of the producing zone to the offtake line at the surface, (c) disposing a choke means in at least one of the fluid communication paths, and (d) producing gas while controlling the choke means to establish sufficient gas flow up the first tubing string to unload liquids from near or below the bottom of the producing zone and to produce the liquids up the first tubing string in association with gas flow.

According to a presently preferred embodiment a single choke means is disposed in the second fluid communication path.

According to another presently preferred embodiment, the second fluid communication path can be the annulus between the first tubing string and the outer surface of the wellbore or it can be a second tubing string (such as a coiled tubing string) located in the annulus between the tubing string and the outer surface of the wellbore or located concentric to the first tubing string.

According to another presently preferred embodiment of the invention, the first tubing string has a sufficiently small diameter so that sufficient gas velocity can be maintained up the first tubing string over the life of the production and so that associated flow of liquids can be maintained and the production zone can be unloaded of liquids.

According to another presently preferred embodiment, the choke means is controlled by a differential pressure controller measuring pressure differential across an orifice plate in the first fluid communication path of the first tubing string.

In accordance with another presently preferred embodiment, particularly for certain paraffin producing gas wells, sufficient choke is applied by the choke means to prevent production of liquids up the annulus.

In accordance with another presently preferred embodiment, the choke means is a valve automatically controlled by a differential pressure controller measuring pressure differential across an orifice plate in the first fluid communication path of the first tubing string.

In accordance with yet another presently preferred embodiment, the tubing string is disposed from a tubing coil.

DESCRIPTION OF THE PREFERRED EMBODIMENTS

Figure 1:
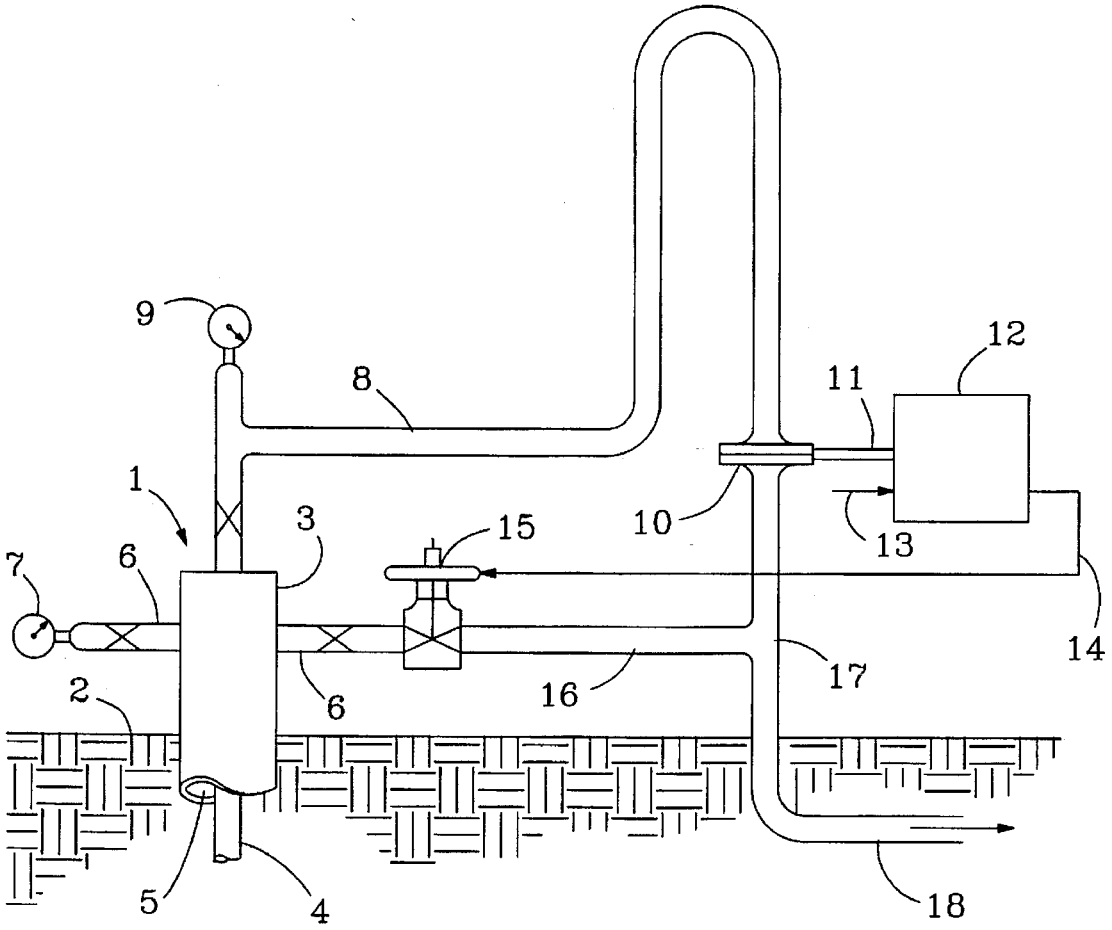
FIG. 1 is a schematic illustration of a well completion employing a presently preferred embodiment of the invention, wherein a choke means is disposed in the second communication path and an orifice plate is disposed in the first communication path to control the choke means by way of a differential pressure controller.

In accordance with the invention, a method of flow rate control is provided that ensures a gas velocity in the tubing string above the minimum necessary to maintain mist flow, allowing all liquids to be produced up the tubing string. Usually, any gas volumes in excess of those required to lift liquids are produced up the annulus, typically the annulus between the casing and tubing, when pressure drop due to friction is negligible.

As many gas wells have liquid unloading problems caused by oversized tubing, resulting in premature abandonment, the invention provides that small tubing (for example 1.61 inches internal diameter) can be used in such wells, regardless of anticipated flow rate, without restricting production capacity. Though this embodiment is often advantageous, there is no inherent reason why larger tubing sizes (for example, 2 inches internal diameter, or larger) cannot be employed in appropriate circumstances.

In some circumstances, for example, when a packer is already in the well preventing flow up the casing annulus, another tubing string of larger diameter than the first tubing string can be employed for the excess volume flow. This can be in the configuration of either parallel or concentric tubing strings. In accordance with the invention, maintaining liquid flow up the small or first tubing string, typically by mist flow, is accomplished by regulating the amount of excess gas allowed to exit the fluid communication path, typically the annulus or the second tubing string.

Control can be effected by a single loop process using readily available, simple, reliable, off-the-shelf, oil field equipment costing but a few hundred dollars. Thus, an orifice plate in holder, a differential pressure controller, and a pneumatic motor valve can readily be employed. The controller compares the differential pressure across the orifice plate to the set point, and open or closes the control valve on the tubing or casing annulus as needed to maintain the set point. In the initial phase of the well's life, the majority of gas flow goes through the control valve. As production declines over time, all flow eventually goes via the tubing. Intermittent flow or plunger lift can still also be used in combination with the smaller tubing when gas flow drops to very low rates near the end of the production life of the well.

The application of an orifice plate for flow rate control can readily be modeled mathematically. Calculations can be made to determine minimum gas flow rates required to prevent liquid loading over a range of tubing pressures by those skilled in the art. Details on one method are disclosed in Turner et. al., "Analysis And Prediction Of Minimum Flow Rate For The Continuous Removal Of Liquids From Gas Wells," Journal of Petroleum Technology, September, 1969, pages 1465–1482. That article is herewith incorporated by reference to teach such mathematic modeling. Industry accepted AGA-3 calculations for flow across an orifice plate can be employed to determine the plate differentials needed to achieve the flow rates of the Turner disclosure. In carrying out the modeling, it was unexpectedly observed that the required differential pressures stayed essentially constant over the entire flowing pressure range. This leads to the unexpected result that a differential pressure controller can be employed to maintain gas flow rates above the minimums needed to maintain mist flow.

In accordance with one preferred embodiment of the invention, the first tubing string is disposed from a tubing coil. C. M. Hightower, "Coiled Tubing Operation And Services", World Oil, 1992, pages 49–56 discloses production applications of coiled tubing and is herewith incorporated by reference as a teaching in support of the tubing coil embodiment of the invention.

In accordance with another presently preferred embodiment of the invention, the system of the invention can be employed in a manner to keep the flow rate up the annulus low enough to prevent liquids from being produced up the annulus within the casing. This is highly advantageous for certain producing formations, for example, in the Hobbs area of New Mexico, where the wells are prolific and produce paraffin. This embodiment provides a means of preventing paraffin deposition on the casing walls. Using this embodiment of the method of the invention to make sure that all liquids flow up the tubing means that paraffin deposits can be mechanically removed, which is quite advantageous since paraffin removal is very difficult in the annulus between the tubing and the casing.

EXAMPLES

FIG. 1 shows a schematic illustration of a well completion employing one presently preferred embodiment of the invention.

Thus, gas well 1 penetrates via a borehole from surface 2 to a producing formation (not shown). Casing 3 penetrates to below the producing formation as does tubing string 4. Casing 3 has perforations (not shown) in the producing formation to allow entry of gas into the annulus 5 between the casing and the tubing string 4. Tubing string 4 terminates below the bottom of the producing formation. Tubing string 4 connects via line 8 to orifice plate holder 10 and has pressure gauge 9 in fluid communication therewith. Orifice plate holder 10 connects via line 11 to pneumatic pressure differential controller 12 which has a 30 psig gas supply 13. Pneumatic pressure differential controller 12 connects by means of control line 14 and controls control valve 15 in line 16 to control gas flow from the well in accordance with this embodiment of the invention. Line 16 connects with line 8 via tee fitting 17 to offtake line 18. Line 6 and gauge 7 are employed to monitor gas pressure in the annulus 5. Control valve 15 is properly sized to prevent oscillation.

An experimental application of the inventive method as shown in the drawing was installed. A well was equipped with 1.66 inch OD (1.38 inch internal diameter) production tubing and flowed at a rate of 978 MCFPD during its state deliverability test. During this test, the flowing tubing pressure was 350 psi, and the casing pressure was 540 psi. The differences in these pressures is attributed to the friction caused by flowing at a high rate up the small tubing.

A ⅝ inch orifice plate was installed at 10 and connected to a Kimray pressure differential controller (PDC) (12). Supply gas was brought to the controller and the controller output was run to a Kimray high pressure motor valve equipped with ⅝ inch EP trim (15). This control valve was installed directly on the casing outlet valve. The outlet of this valve connected to the tubing downstream of the orifice plate at 17, and then connected to the well offtake 18. Prior to this installation, gas production was MCFPD at 300 psi tubing pressure (sales line pressure had been reduced some by gas purchaser). Immediately after installation, production was 1000 MCFPD at 300 psi tubing pressure and 350 psi casing pressure period. The initial production increase was caused by suddenly reducing the back pressure on the well from 540 psi casing pressure to 350 psi. A sustained 75 MCFPD production increase was realized. The value of the inventive process is indicated in that the project cost was paid out of first week of production.

Though the foregoing examples disclose the best mode presently demonstrated by the inventor to be operable, they should in no way be construed to limit the scope and applicability of the invention as set forth in the claims and equivalents hereof. Other embodiments and modes are briefly set forth herein or will suggest themselves to those skilled in the art in view of the claims or equivalents hereof.

I claim:

1. A method for producing gas in association with liquids from a wellbore comprising:

(a) disposing a first tubing string into the wellbore to near or below the bottom of a producing zone and having a first fluid communication path from near or below the bottom of the producing zone to an offtake line at the surface, wherein the first tubing string has a sufficiently small diameter so that sufficient gas velocity can be maintained up the first tubing string over the life of the production and so that associated flow of liquids can be maintained and the production zone can be unloaded of liquids, (b) disposing within the wellbore a second fluid communication path from near or below the bottom of the producing zone to the offtake line at the surface, (c) disposing a single choke means in the second fluid communication path; and (d) producing gas while controlling the choke means to establish sufficient gas flow up the first tubing string to unload liquids from near or below the bottom of the producing zone and produce the liquids up the first tubing string in association with gas flow.

2. The method of claim 1 wherein the first tubing string is a coiled tubing string.

3. The method of claim 1 wherein the choke means is disposed in the second fluid communication path.

4. The method of claim 1 wherein the second fluid communication path is the annulus between the first tubing string and the inner surface of the wellbore.

5. The method of claim 1 wherein the second fluid communication path is a second tubing string located in the annulus between the first tubing string and inner surface of the wellbore.

6. The method of claim 1 wherein the choke means is controlled by a differential pressure controller measuring pressure differential across an orifice plate in the first fluid communication path of the first tubing string.

7. The method of claim 1 wherein sufficient choke is applied by the choke means to prevent production of liquids up the annulus.

8. The method of claim 1 wherein the choke means is automatically controlled by a differential pressure controller measuring pressure differential across an orifice plate in the first fluid communication path of the first tubing string.

9. The method of claim 1 and further including the steps of:

(a) disposing an orifice plate in the first fluid communication path to the offtake line at the surface; and (b) determining the required minimum gas flow rate of gas in the first fluid communication path that will maintain mist flow in said first fluid communication path in order to size said orifice plate prior to disposing in the first fluid communication path and to determine the plate differential required to support mist flow.

* * * * *